United States Patent [19]

Aylor et al.

[11] Patent Number: 4,741,269

[45] **Date of Patent: * May 3, 1988**

[54] DAMPENING APPARATUS FOR PRINTING PRESS

[75] Inventors: John E. Aylor, Fort Worth; Jose A. Villarreal, Mesquite, both of Tex.

[73] Assignee: Graphic Specialties, Inc., Garland, Tex.

[ * ] Notice: The portion of the term of this patent subsequent to Jun. 30, 2004 has been disclaimed.

[21] Appl. No.: 65,256

[22] Filed: Jun. 22, 1987

Related U.S. Application Data

[63] Continuation of Ser. No. 894,444, Aug. 1, 1986, Pat. No. 4,676,156, which is a continuation of Ser. No. 800,089, Nov. 20, 1985, abandoned, which is a continuation of Ser. No. 616,719, Jun. 4, 1984, abandoned.

[51] Int. Cl.[4] ..... B41F 7/40; B41F 31/30

[52] U.S. Cl. ..... 101/148; 101/351

[58] Field of Search ..... 101/148, 350, 351, 352

[56] References Cited

U.S. PATENT DOCUMENTS 3,673,959 7/1972 Jezuit et al. ..... 101/148

3,842,735 10/1974 Southam et al. ..... 101/148 X 4,440,081 4/1984 Beisel ..... 101/350 X 4,676,156 6/1987 Aylor et al. ..... 101/351 X

*Primary Examiner*—Clifford D. Crowder

*Attorney, Agent, or Firm*—Hubbard, Thurman, Turner & Tucker

[57] ABSTRACT

A dampening liquid application apparatus for a lithographic press includes a motor driven metering roller drivably engaged with a transfer roller which in turn is engageable with an applicator roller for transferring dampening liquid to a plate cylinder. The metering and transfer rollers are driven through a gear train and are mounted on support members which permit pivotal movement of the support members such that the transfer roller may be disengaged from the applicator roller and, through a lost motion coupling, the applicator roller may be disengaged from the plate cylinder. A distribution roller is engageable with the dampener applicator roller and one of the form rollers of the press inking train. The distribution roller is selectively movable to and maintainable in position in which the distribution roller is disengaged from the form roller but is engaged with the applicator roller.

9 Claims, 5 Drawing Sheets

DAMPENING APPARATUS FOR PRINTING PRESS

This is a continuation of copending application Ser. No. 894,444 filed Aug. 1, 1986, now U.S. Pat. No. 4,676,156, which is continuation of application Ser. No. 800,089, filed Nov. 20, 1985, now abandoned, which is continuation of application Ser. No. 616,719, filed Jun. 4, 1984, now abandoned.

BACKGROUND OF THE INVENTION

A. Field of the Invention

The present invention pertains to a continuous water applicator or dampener for use with lithographic type printing presses and duplicators.

In the art of lithographic presses and similar types of reproduction equipment there has been an ongoing need for improvements in the dampening apparatus used to apply water to the plate cylinder. Although a wide variety of dampening devices have been developed for lithographic presses and the like there has been a particular need for improved apparatus which is powered by a separate drive motor wherein the speed of a metering roller and transfer roller may be selectively controlled with respect to a form or applicator roller drivably engaged with the plate cylinder itself.

The wide variety of multi-color printing carried out in lithographic or similar printing processes also requires relatively fine adjustment of the amount of water or dampening liquid applied to the plate cylinder and the uniformity of the application of water. Accordingly, there have also been problems with prior art dampening apparatus as regards the adjustment of the pressure between the respective rollers in contact with each other to control the amount of water transferred from the water fountain to the plate cylinder. In this regard there has been a need for improvements in the roller support structure whereby the positional relationship or engagement pressure between the rollers may be easily adjusted.

It is also particularly advantageous to provide means in a dampening apparatus for disengaging the metering and transfer rollers from the dampener form or applicator roller when operation of the dampening apparatus is not required and to be able to use the dampener form or applicator roller as an additional inking distribution roller. The present invention provides several improvements in the art of dampening apparatus for printing press and duplicating equipment which meet the desiderata discussed above as well as providing other features which are particularly useful and will be appreciated by those skilled in the art of such apparatus.

SUMMARY OF THE INVENTION

The present invention provides an improved dampening apparatus for use with lithographic type printing presses and duplicating equipment wherein continuous application of a controlled film of a waterlike solution may be applied to the press plate cylinder or the like.

In accordance with one aspect of the present invention there is provided a dampening apparatus having a water or dampening solution metering roller which is adapted to be driven at variable speeds to meter the dampening solution to a transfer roller which in turn is engageable with an applicator roller for applying a precisely controlled amount of dampening solution directly to the plate cylinder of a lithographic type printing press. The metering roller-transfer roller combination is driven by a variable speed motor and is mounted on a pair of movable support plate members which provide for pivoting the transfer roller into and out of engagement with an applicator roller.

In accordance with another aspect of the present invention a dampening apparatus is provided which includes improved support structure for a metering roller and a transfer roller whereby the engagement pressure between these rollers may be selectively adjusted to control the amount of solution transferred to the applicator roller and to control the distribution of the dampening solution. The metering and transfer rollers are mounted in a unique bearing support structure wherein the bearings are resiliently biased in a preselected position of the respective rollers relative to each other and the respective rollers may be easily demounted for cleaning, repair or replacement. The roller support structure is advantageously mounted for pivotal movement on opposed frame plates of the apparatus.

The present invention still further provides a unique arrangement of a manual actuating mechanism and lost motion coupling for engaging and disengaging the metering and transfer roller assembly with respect to the applicator roller and for disengaging the applicator roller from the plate cylinder.

In accordance with yet another aspect of the present invention an auxiliary distribution roller is provided and is adapted to be supported on the press on unique support bracket members and operably associated with the dampening apparatus for washing the applicator roller and for use as an ink or dampening liquid distribution bridging roller, if desired.

The dampening apparatus of the present invention is also contructed in a superior manner to provide for easy adaptation to a number of different types of presses and duplicating machines. Those skilled in the art will more fully appreciate the advantages and superior features of the invention described above as well as additional aspects thereof upon reading the detailed description which follows in conjunction with the drawing.

DESCRIPTION OF THE PREFERRED EMBODIMENT

Figure 1:
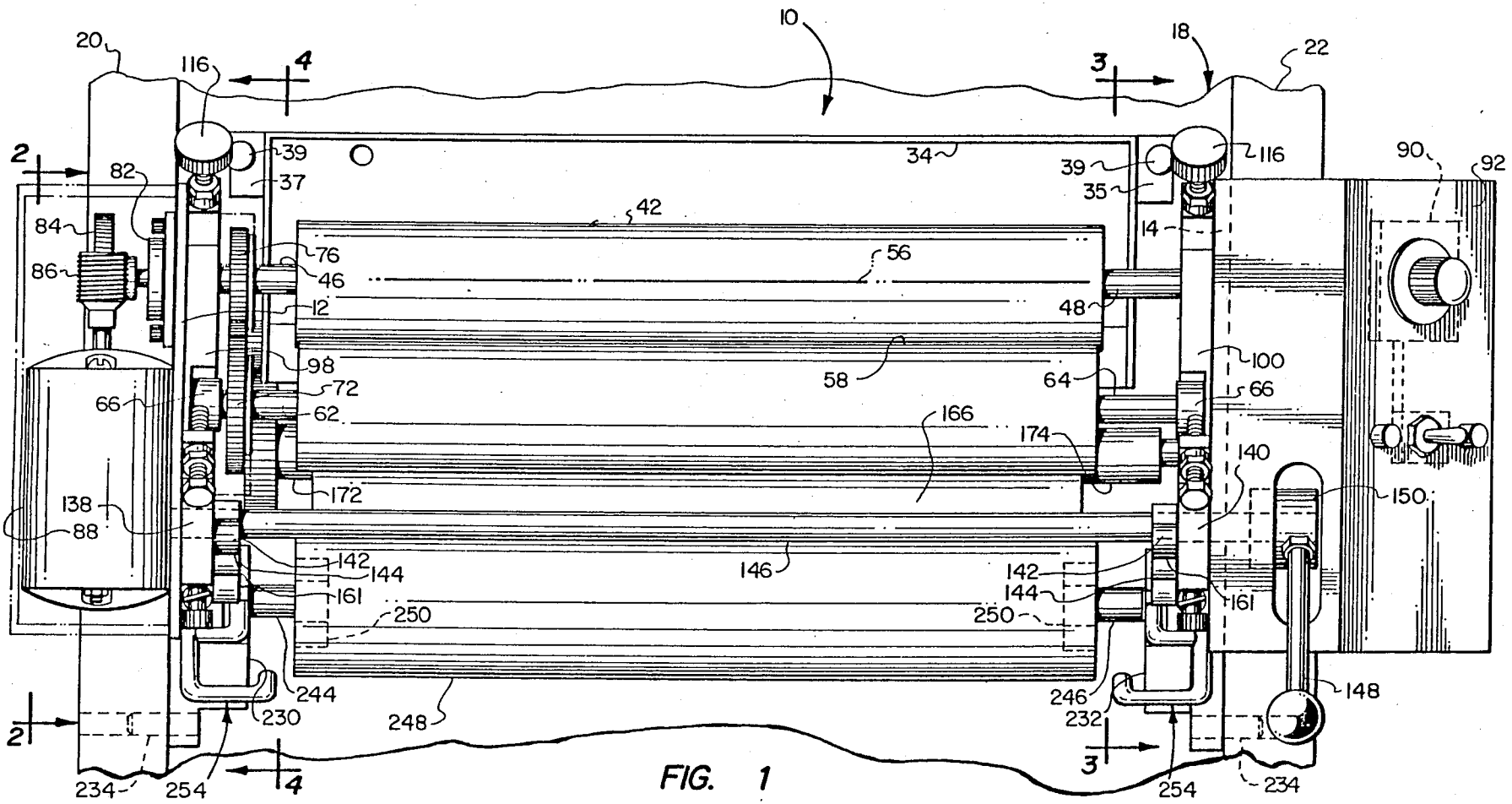
FIG. 1 is a plan view of the dampening apparatus of the present invention.

In the description which follows like parts are marked throughout the specification and drawing with the same reference numerals, respectively. The drawing figures are not necessarily to scale and certain features of the invention may be shown exaggerated in scale or in somewhat schematic form in the interest of clarity.

Figure 2:
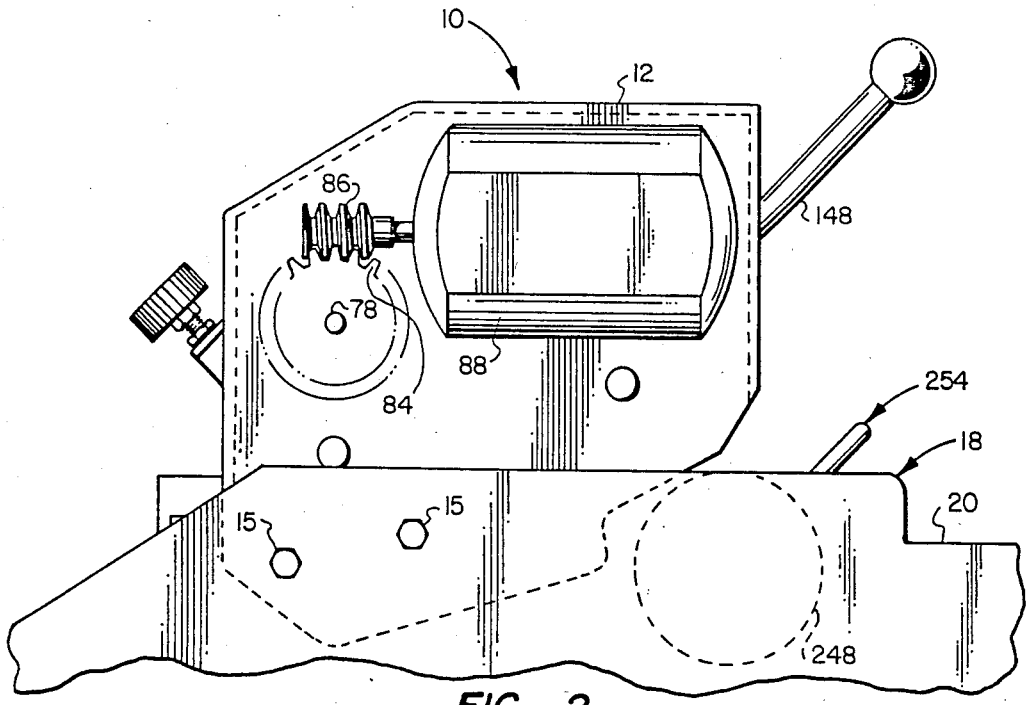
FIG. 2 is an end view taken from line 2—2 of FIG. 1.

Referring to FIGS. 1 and 2, the dampening apparatus is generally designated by the numeral 10 and is characterized by a frame comprising opposed frame plates 12 and 14. As shown by example in FIG. 2, the apparatus 10 may be mounted on a lithographic or similar type printing press by suitable fasteners 15 secured in selectively placed mounting holes, not shown, in the frame plates 12 and 14. The apparatus 10 may be selectively mounted on one of a number of lithographic type printing presses or other similar duplicating type equipment. In the drawing figures the numeral 18 designates a portion of a lithographic type printing press having opposed side plates 20 and 22, a rotating plate cylinder 24, FIGS. 3, 4 and 5, including a plate cylinder gear 26, FIGS. 5 and 6 and a plurality of ink distribution and applicator rollers 28, 29 and 30, FIG. 5, respectively. The gear 26 is typically coaxial with the axis of rotation of the cylinder 24 and suitably drivably connected thereto. The press 18 is somewhat exemplary and it will be understood that the dampening apparatus 10 may be used in conjunction with a variety of different types of printing press and duplicator equipment. In drawing FIGS. 3, 4 and 5 the various rollers are depicted by showing their circumferential contact surfaces in phantom and the gears described are depicted by showing their pitch circles or addendum or dedendum circles for clarity.

Referring to FIGS. 1, 3, 4 and 7, the apparatus 10 includes a dampening liquid fountain comprising a relatively shallow elongated pan 34 which is supported on the apparatus 10 on a pair of spaced apart support plates 36 and 38 which are mounted on respective ones of the frame plates 14 and 12. The fountain pan 34 includes opposed bracket parts 35 and 37 which are adapted to be secured to the support plates 36 and 38 by respective screws 39. The frame of the dampening apparatus 10 includes an elongated tie rod 40 extending between and secured to the plates 36 and 38. Dampening liquid may be conducted to the fountain pan 34 from a suitable source, not shown, and including means for maintaining a predetermined level of dampening liquid in the fountain sufficient to continuously immerse at least a portion of an elongated metering roller 42.

Figure 6:
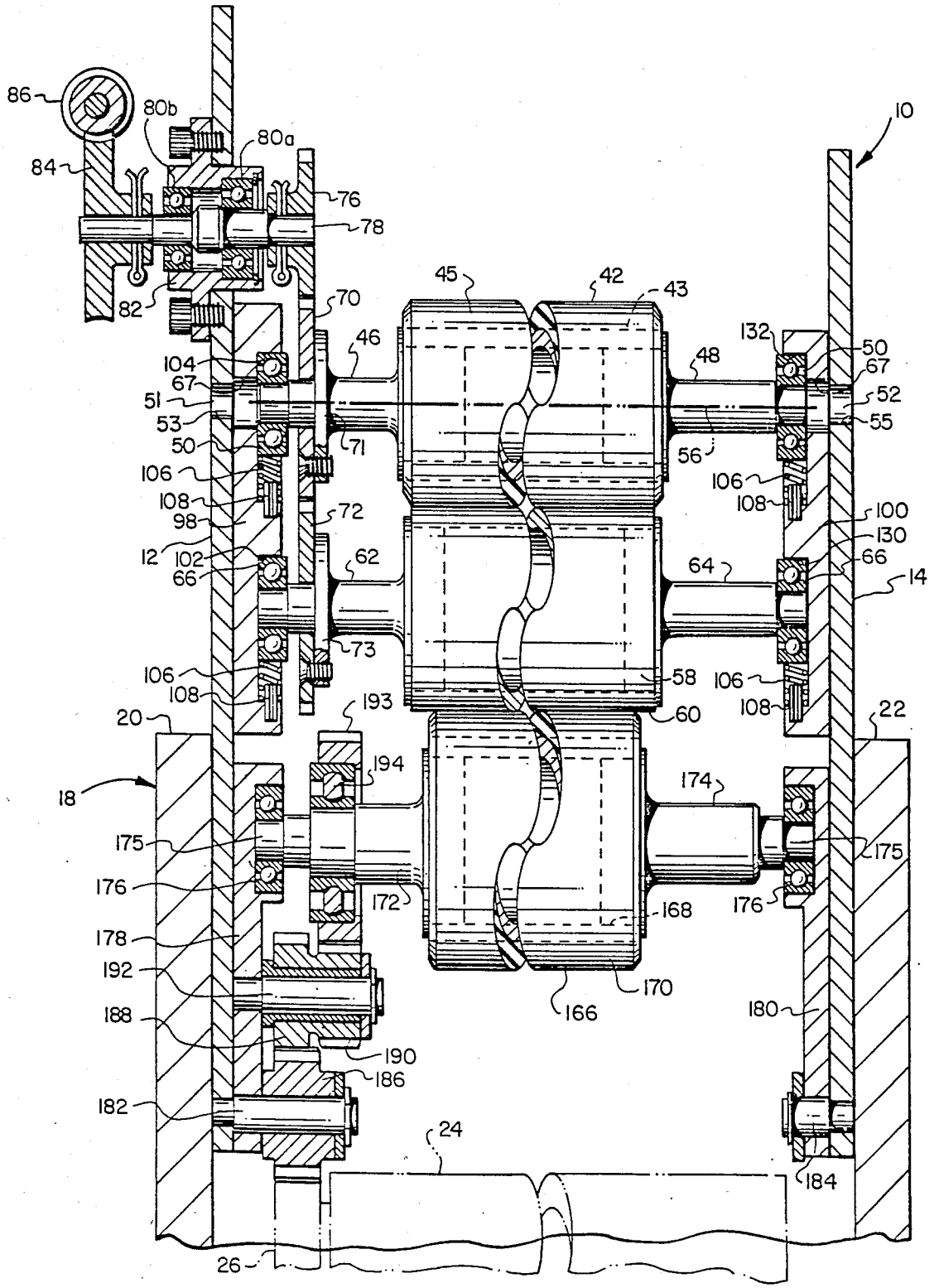
FIG. 6 is a developed section view taken from line 6—6 of FIG. 4.

Referring now primarily to FIG. 6, the metering roller 42 includes an elongated core portion 43 for supporting a relatively soft urethane cylindrical sleeve 45. The metering roller 42 also includes opposed coaxial trunnions 46 and 48 which are supported, respectively, in ball bearing assemblies 50, and the metering roller is rotatable about a longitudinal axis. The roller 42 is operable to be engaged with a transfer roller 58 including a cylindrical chrome plated cylinder portion 60 which is engageable with the urethane sleeve 45 of the roller 42. The transfer roller 58 includes opposed trunnions 62 and 64 which are supported in sealed ball bearing assemblies 66, respectively.

As shown in FIG. 6, the rollers 42 and 58 are in driven engagement with each other by way of intermeshing gears 70 and 72 which are suitably secured to cylindrical flange portions 71 and 73 of the respective roller trunnions 46 and 62. The gear 70 is also meshed with a drive gear 76 which is supported by a shaft 78 rotatably mounted in spaced apart bearings 80a and 80b supported in a sleeve member 82. The sleeve member 82 is removably mounted on the frame plate 12. A second gear 84 is drivably keyed to the shaft 78 and is meshed with a worm 86. The worm 86 is connected to the output shaft of a drive motor 88 mounted on the apparatus 10 and preferably secured to the outer side of the frame plate 12. The drive motor 88 is preferably a variable speed electric motor which may be selectively controlled to operate at a preselected speed by a controller 90, FIG. 1, suitably supported on a control panel member 92 secured to the outer side of the frame plate 14. The drive motor 88 and the controller 90 are not believed to require detailed description to enable one to practice the present invention. Suffice it to say that the motor 88 and the controller 90 may be selected to utilize available electric power sources of either AC or DC characteristics to provide a variable output speed to the worm 86 for driving the rollers 42 and 58 at a preselected speed.

Figure 3:
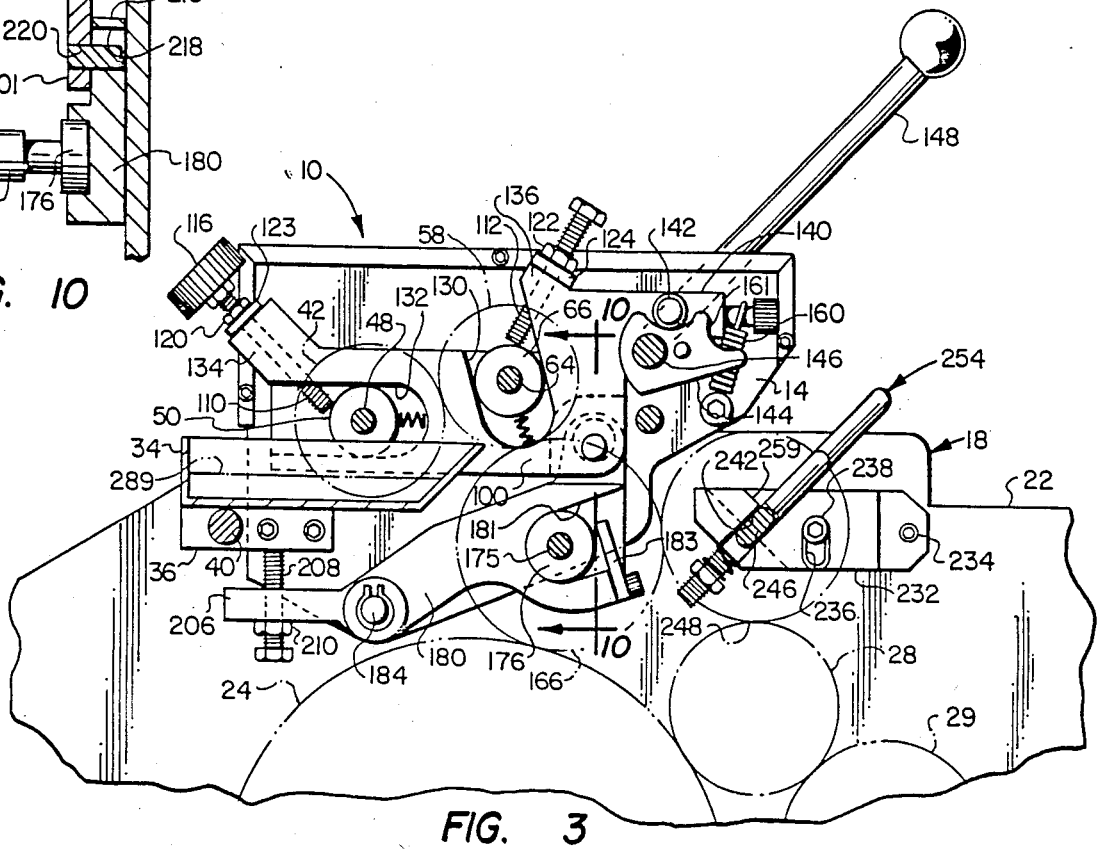
FIG. 3 is a section view taken from line 3—3 of FIG. 1.
Figure 5:
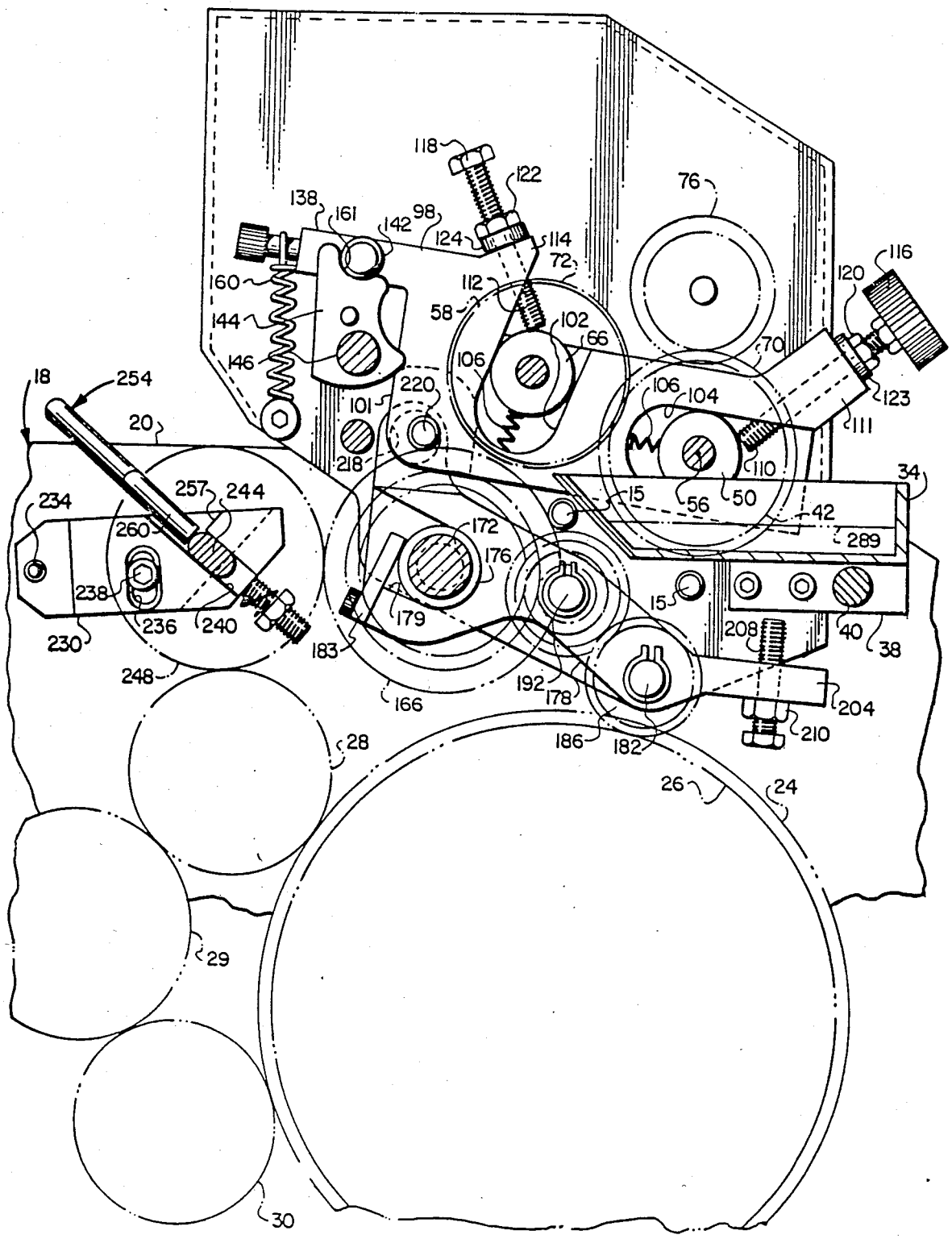
FIG. 5 is a section view taken from the same line as the view of FIG. 4 but on a larger scale and showing the transfer and applicator rollers disengaged.
Figure 4:
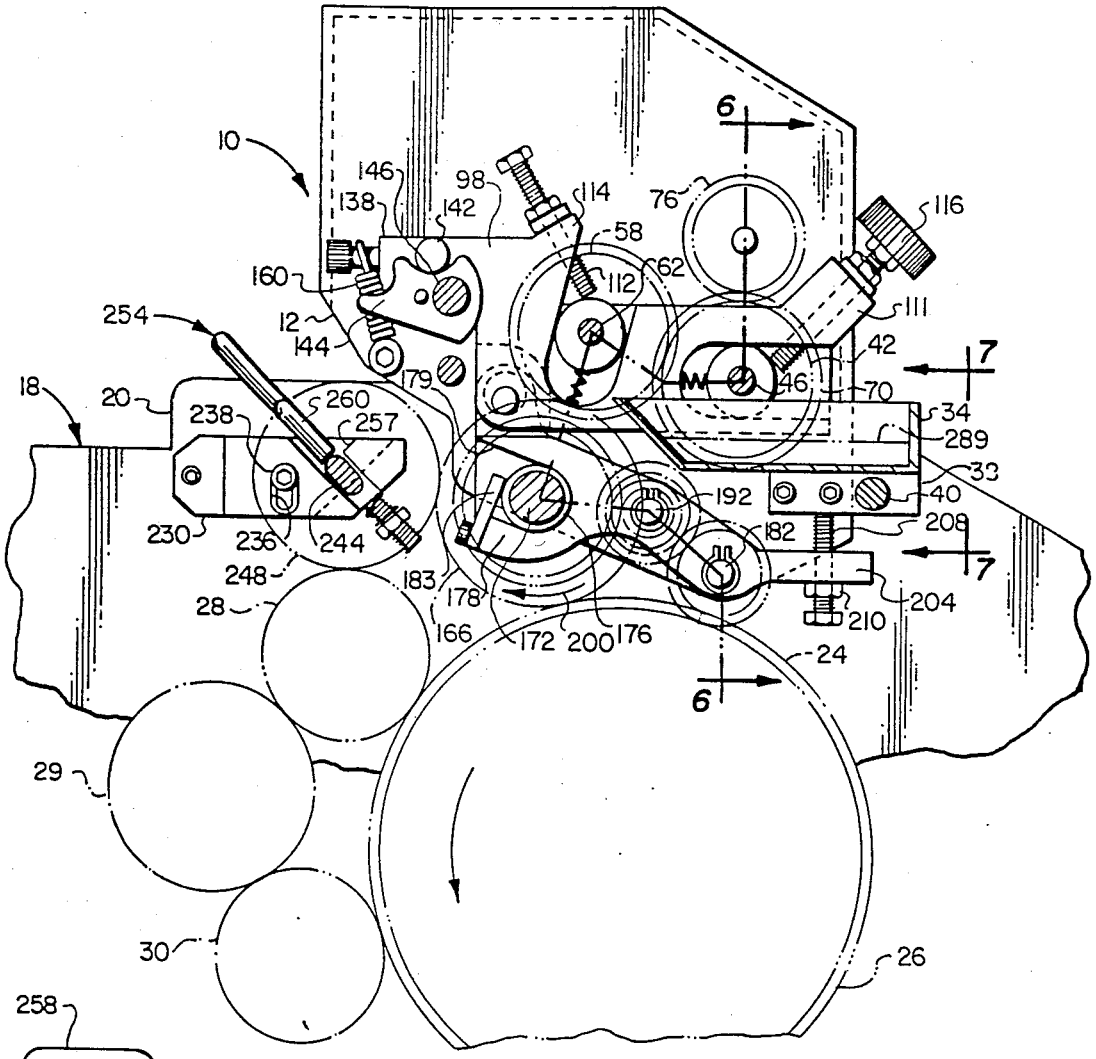
FIG. 4 is a section view taken from line 4—4 of FIG. 1.

Referring to FIGS. 3, 4, 5 and primarily to FIG. 6, the rollers 42 and 58 are supported in their respective bearings 50 and 66 which are disposed in a pair of spaced apart support members 98 and 100. The support members 98 and 100 are provided with bores 67 for receiving opposed pivot pins 51 and 52, respectively. The pins 51 and 52 are journalled in opposed bores 53 and 55 formed in the respective frame plates 12 and 14. The support member 98 includes two elongated slots 102 and 104 which extend at acute angles with respect to each other, FIGS. 4 and 5, and are dimensioned to receive the outer races of the bearing assemblies 66 and 50, respectively. The bearing assemblies 50 and 66 are adapted to be biased toward the open ends of the slots 102 and 104 by coil springs 106 which are each secured in the respective slots by an anchor pin 108, respectively.

Referring to FIG. 5, the positions of the bearing assemblies 50 and 66 in the support member 98 are determined by elongated threaded stop members 110 and 112 which are respectively threadedly engaged with bosses 111 and 114 formed as an integral part of the support member 98. The stop members 110 and 112 include respective head portions 116 and 118 whereby the position of the distal ends of the stop members, respectively, may be adjusted to position the bearing assemblies 50 and 66 in the slots 102 and 104. Locknuts 120 and 122 are threadedly engaged with the respective stop members 110 and 112 and with friction washers 123 and 124 whereby the position of the respective stop members 110 and 112 may be selectively adjusted and locked to predetermined the positional relationship of the rollers 42 and 58.

As shown in FIGS. 3 and 6, the support member 100 is a virtual mirror image of the support member 98 and includes respective elongated slots 130 and 132 for supporting the bearing assemblies 66 and 50 at the respective opposite ends of the rollers 58 and 42. The support member 100 also includes integrally formed bosses 134 and 136, FIG. 3, for supporting stop members 110 and 112, respectively, and whereby the bearing assemblies 66 and 50 disposed in the slots 130 and 132 are biased toward engagement with the respective stop members by coil springs 106 also retained in the respective slots by retaining pins 108. The stop members 110 and 112 are lockable in preselected positions on the bosses 134 and 136 by respective locknuts 120 and 122 engaged with friction washers 123 and 124, respectively.

Referring now to FIGS. 1, 3, 4 and 5, the support members 98 and 100 include laterally projecting tang portions 138 and 140, respectively, on which are mounted opposed coaxial cam followers 142 which are engageable by rotating cam members 144 supported on and rotatable with an elongated actuator rod 146. The rod 146 is rotatably supported by the frame plates 12 and 14 and is connected at one end to an actuating lever 148 having a hub portion 150, FIG. 1, suitably keyed to an end of the rod 146 projecting through the frame plate 14. The support members 98 and 100 are biased to rotate about the axis 56 in a counterclockwise direction, viewing FIG. 5, by coil springs 160 which are suitably connected at their opposite ends to the tang portions 138 and 140 and the respective frame plates 12 and 14.

However, in response to rotation of the actuating rod 146 in a clockwise direction, viewing FIG. 5, to engage the cam followers 142 by the opposed cams 144, the support members 98 and 100 may be rotated about the axis 56 in a clockwise direction, viewing FIG. 5, to disengage the transfer roller 58 from an applicator roller, generally designated by the numeral 166. Referring to FIG. 6, the roller 166 includes a cylindrical core member 168 and a suitable rubber or urethane sleeve 170 disposed thereon for application of the dampening liquid to the applicator roller from the transfer roller and then to the plate cylinder 24. The applicator roller 166 includes opposed trunnions 172 and 174 having respective reduced diameter portions suitably journalled in ball bearing assemblies 176. The bearing assemblies 176 are mounted in opposed support members 178 and 180 which are pivotally mounted on the frame plates 12 and 14 by respective pivot pins 182 and 184. The support members 178 and 180 include respective open ended slots 179 and 181 for receiving the bearing assemblies 176 which are retained in the slots by respective clamp members 183. The pivot pin 182 also serves as a support axle for a pinion 186 meshed with the plate cylinder gear 26 and also meshed with a cluster gear 188, 190 rotatably supported on a stub shaft 192 mounted on the support member 180. The cluster gear 190 is meshed with a driven gear 193 which is supported on a one-way clutch assembly 194 supported on the trunnion 172. The clutch assembly 194 may be of a conventional cam and roller type which permits the roller 166 to rotate relative to the gear 193 in the direction of arrow 200, FIG. 4, in the event that contact between the plate cylinder 24 and the roller 166 tends to drive the roller ahead of the driving gear train 186, 188, 190 and 193.

Referring further to FIGS. 3 and 4, the respective support members 178 and 180 include laterally projecting bosses 204 and 206 which threadedly support a pair of threaded stop members 208 comprising hex head machine screws. Locknuts 210 are also threaded over the stop members 208 and are engageable with the respective bosses to lock the stop members in a predetermined position with respect to the bosses 204 and 206. The stop members 208 are engageable with the respective plates 36 and 38 to limit the rotation of the support members 178 and 180 in a clockwise direction, viewing FIG. 3, to predetermine the engagement pressure between the plate cylinder 24 and the roller 166.

Figure 10:
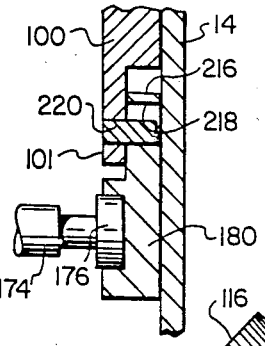
FIG. 10 is a section view taken from line 10—10 of FIG. 3.

The roller 166 may be lifted out of engagement with the plate cylinder 24 by means of a unique lost motion coupling between the support members 100 and 180, for example, and as shown in FIGS. 3 and 10. The support member 180 includes a generally upwardly projecting boss 216 having a cylindrical opening 218 formed therein and positioned adjacent to an overlapping projection 101 on the support member 100. A coupling pin 220 is supported on the support member 100 and projects into the opening 218 but is of a diameter somewhat less than the diameter of the opening 218 to permit some movement of the support member 100 and the coupling pin 220 about the axis 56 before engagement of the boss 216 to lift the support member 180 and the roller assembly 166 away from contact with the plate cylinder 24. As shown in FIG. 5, a second coupling pin 220 is also disposed on a projection 101 on member 98 and projects into an opening 218 in a boss formed on member 178. Accordingly, in response to actuation of the cams 144 to engage the cam followers 142 to rotate the support members 98 and 100 about the axis 56, the transfer roller 58 will first disengage from the roller 166 followed by disengagement of the roller 166 from the plate cylinder 24 when it is desired to deactivate the operation of the dampening apparatus 10.

The support members 98 and 100 are lockable in their deactivated position of engagement by the cams 144 by the provision of a somewhat arcuate recesses 161 on the cam which allows the cam followers 142 to remain in nested engagement with the respective cams 144 when they are rotated to engage the followers and to lift the support members 98 and 100 against the bias of the springs 160. The cams 144 preferably move to an overcenter position relative to the followers 142 and engage suitable stops, not shown, in the position of the cams indicated in FIG. 5, to hold the rollers 42, 58 and 166 stable in the disengaged position.

Thanks to the arrangement of the metering roller 42 and the transfer roller 58 the engagement pressure between these rollers 42 and 58 may be selectively adjusted at each end of the rollers by adjustment of the stop members 110, respectively, to adjust the positions of the axis of rotation of the roller 42. In this way a squeezing action between the rollers 42 and 58 may be selectively varied to control the amount of dampening liquid which is transferred from the metering roller 42 to the transfer roller 58. The stop members 112 are operable to adjust the engaging force between rollers 58 and 166. By selective adjustment of the stop members 110 any uneven distribution of dampening liquid may be compensated for since the opposite ends of the rollers 42 and 58 are independently adjustable relative to each other.

Each of the rollers 42 and 58 may be easily demounted from the respective support members 98 and 100 by backing out the stop members 110 and 112 so that they are clear of the open ends of the respective slots in the support members which support the bearing assemblies 50 and 66 whereby the rollers may be easily demounted from the apparatus 10 for cleaning or repair. Due to the arrangement of the gear train including the gears 76, 70 and 72, the roller 42 may be removed from the apparatus 10 together with its gear without requiring major disassembly of the components of the drive train for the rollers 42 and 58.

Moreove, due to the arrangement of the support members 98, 100, 178 and 180 and the lost motion coupling formed between the support members 100 and 180, the transfer roller 58 may be disengaged from the applicator roller 166 so that during periods when the dampening apparatus 10 is not in use or the press 18 is not in use the motor 88 may be operated to continue driving the metering roller 42 and transfer roller 58 to provide application of dampening fluid to the transfer roller 58 and prevent dehydration of these two rollers. By selectively varying the speed of the drive motor 88 the amount of dampening fluid transferred to the applicator roller 166 may also be selectively controlled through the speed relationship between the transfer roller 58 and the applicator roller 166.

Referring again to FIGS. 1, 3 and 4, the dampening apparatus 10 of the present invention also contemplates the provision of spaced apart support brackets 230 and 232 which are essentially mirror images of each other. The brackets 230 and 232 each include a support pin 234 projecting laterally therefrom for pivotally supporting the brackets on the press frame plates 20 and 22, respectively. The brackets 230 and 232 each also include an alongated slot 236, see FIG. 8 also, for receiving a lock screw 238 each of which are threadedly engaged with the respective support plates 20 and 22 to support the respective brackets 230 and 232 in a predetermined position, if desired. The brackets 230 and 232 include respective channel shaped slots 240 and 242 for receiving oppositely projecting trunnions 244 and 246 of a distribution roller 248. Suitable bearing means 250 are supported on the trunnions 244 and 246 for allowing the roller 248 to rotate relative to the trunnions. The roller 248 may also include suitable oscillation mechanism, not shown, for causing the roller 248 to oscillate along its own axis of rotation. The roller 248 is biased toward engagement with the applicator roller 166 and toward one of the ink distribution rollers 28 by a pair of spaced apart clamp members 254 which are supported on the brackets 230 and 232, respectively.

Figure 9:
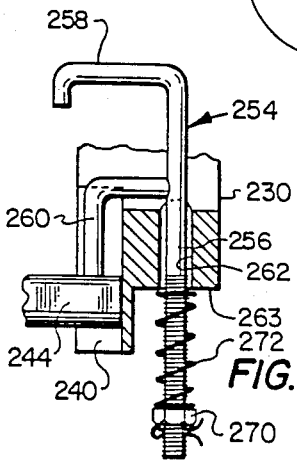
FIG. 9 is a section view taken from line 9—9 of FIG. 8.
Figure 8:
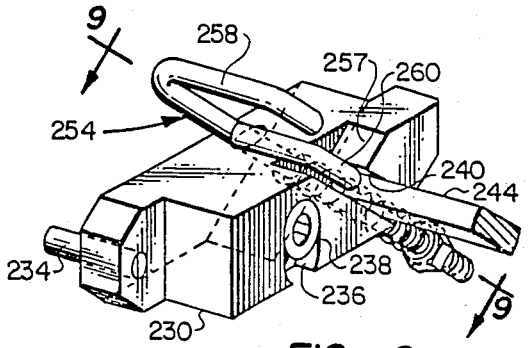
FIG. 8 is a perspective view of one of the support brackets for the auxiliary distribution roller.
Figure 7:
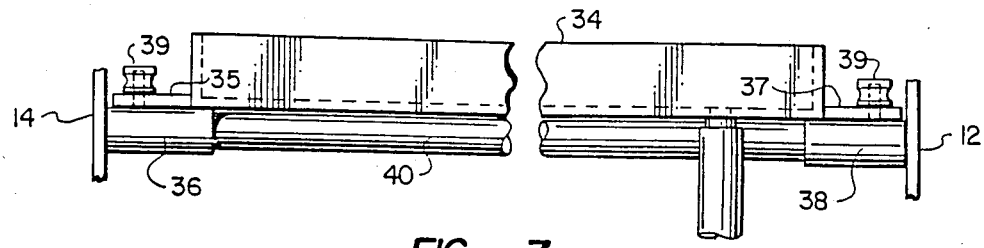
FIG. 7 is a detail view taken from line 7—7 of FIG. 4.

The brackets 230 and 232 are mirror images of each other and certain structural features of each will be understood by way of example for the following description of bracket 230. Referring to FIGS. 8 and 9, the clamp members 254 each include a generally cylindrical rodlike shank 256, a laterally projecting handle portion 258 and a laterally projecting stop portion 260 for engagement with the respective support trunnions 244 and 246 of the roller 248. The shank 256 of each of the clamp members 254 projects through an angled bore 262 formed in each of the bracket members 230 and 232 and the distal end of the shank 256 opposite the handle portion 258 is threaded to receive a retaining nut 270 for retaining a coil spring 272 on the shank 256 and bearing against a surface 263 for biasing the clamp members 254 toward engagement with the roller trunnions 244 and 256, respectively. Accordingly, when the clamp members 254 are in the position shown in FIGS. 3 and 4, the roller 248 is biased toward engagement with the respective rollers 28 and 166 but may be relieved of forcible engagement with these rollers and removed from the brackets 230 and 232, if desired, by pulling the clamp members 254 upwardly and rotating the shanks 256 to move the laterally projecting arm portions 260 out of alignment with the slots 240 and 242 and, upon release of the handle portions 258, the arm portions 260 may be engaged with a flat 257 and 259 formed on each of the brackets 230 and 232, respectively.

The arrangement of the support brackets 230 and 232 is such that when the roller 166 is engaged with the plate cylinder 24 or has been retracted away from plate cylinder the roller 248 may still be engaged with the applicator roller 166 as shown in FIG. 5, so that during washdown of the inking roller system of the press 18 the applicator roller 166 may be operable to receive washing fluid through the roller train including the rollers 28, 29 and 248. On the other hand, the roller 248 may serve as an additional ink or dampening fluid distribution roller through its engagement with the applicator roller 166. The roller 248 may be adjusted by suitable pivotal positioning of the brackets 230 and 232 to engage only the applicator roller 166 for the purpose of aiding in the elimination of repeating print patterns.

The operation of the dampening apparatus 10 is believed to be readily understandable to those skilled in the art from the foregoing description. However, briefly, upon installation of the apparatus 10 on a press such as the press 18, the fountain 34 is filled with fluid to a predetermined level such as indicated by the liquid level line 289 in FIGS. 3, 4 and 5, so that the metering roller 42 becomes partially immersed during rotation to pickup a suitable quantity of dampening fluid. As dampening fluid is picked up on the outer peripheral surface of the roller sleeve 45 it is carried on that surface to the point of engagement of the roller 42 with the roller 58 whereupon, depending on the engagement force between the rollers 42 and 58, at least some of the liquid is transferred to the transfer roller 58 and excess liquid is squeezed or piled up on the surface of the sleeve 45 until it tends to drain back into the fountain 34. Accordingly, the amount of liquid transferred to the transfer roller 58 may be controlled by adjusting the stop members 110 to adjust the position of the rollers 42 and 58 relative to each other. Moreover, the amount of liquid transferred from the roller 58 to the applicator 166 may be controlled by the speed of the motor 88 and the drive gear train between the motor and the rollers 42 and 58 as well as the position of stop members 112. The amount of liquid transferred from the applicator roller 166 to the plate cylinder 24 can also be controlled somewhat by the engagement forced between the roller 166 and the plate cylinder 24 as controlled by the stop members 208 which determine the position of the support members 178 and 180. The ability to independently adjust the exact position of each end of the respective rollers 42, 58 and 166 also assists in controlling the distribution of dampening liquid along the length of the respective rollers.

As previously described when it is desired to disengage the roller 58 from the roller 166 cams 144 are rotated to engage the followers 142 and lift the support members 98, 100, 178 and 180 to the inoperative position previously described and shown in FIG. 5. The roller 248 is, of course, independently operable to be forcibly engaged with the applicator roller 166. The support members 230 and 232 may be pivoted about their support pins 234 relative to the frame plates 20 and 22 to maintain briding contact of the roller 248 with both rollers 28 and 166 regardless of the positions of the roller 166, or to maintain contact between the rollers 248 and 166 only.

Although a preferred embodiment of the improved dampening apparatus of the present invention has been described in detail herein those skilled in the art will recognize that various substitutions and modifications may be made to the specific structure disclosed without departing from the scope and spirit of the invention as recited in the appended claims.

What is claimed is:

1. A dampening apparatus for a lithographic press and the like having a rotating plate cylinder and an inking form roller engageable with said plate cylinder, said apparatus comprising:

an applicator roller for applying dampening liquid to said plate cylinder;

a distribution roller simultaneously engageable with said applicator roller and said form roller while both said applicator roller and said form roller are engaged with said plate cylinder;

means for selectively moving said distribution roller to a position in which said distribution roller is disengaged from said form roller while said distribution roller remains engaged with said applicator roller;

and means for maintaining said distribution roller in said position disengaged from said form roller and in engagement with said applicator roller.

2. The dampening apparatus as claimed in claim 1, including:

a dampening liquid fountain;

a metering roller immersed in liquid in said fountain;

and a transfer roller rotatably engaged with said metering roller and said applicator roller.

3. A dampening apparatus for a lithographic press and the like having a rotating plate cylinder and an inking form roller engageable with said plate cylinder, said apparatus comprising:

a transfer roller;

metering means for applying a metered amount of dampening liquid to said transfer roller;

an applicator roller engageable with said transfer roller and said plate cylinder for applying dampening liquid to said plate cylinder;

a distribution roller simultaneously engageable with said applicator roller and said form roller while both said applicator roller and said form roller are engaged with said plate cylinder;

means for selectively moving said distribution roller to a position in which said distribution roller is disengaged from said form roller while said distribution roller remains engaged with said applicator roller;

and means for maintaining said distribution roller in said position disengaged from said form roller and in engagement with said applicator roller.

4. The dampening apparatus as claimed in claim 3 wherein said metering means includes:

a dampening liquid fountain;

and a metering roller immersed in liquid in said fountain and rotatably engaged with said transfer roller.

5. The dampening apparatus as claimed in claim 4, including:

a frame adapted to mount on said press, wherein said dampening liquid fountain is mounted on said frame, and said metering roller, transfer roller and applicator roller are rotatably mounted on said frame.

6. The dampening apparatus as claimed in claim 5, wherein said distribution roller is mounted on spaced apart pivotal brackets, and said maintaining means includes lock screw means for locking said brackets in a position in which said distribution roller is engaged with said applicator roller while said distribution roller is disengaged from said form roller.

7. The dampening apparatus as claimed in claim 6, wherein said brackets include spring means for biasing said distribution roller into engagement with said applicator roller.

8. A dampening apparatus for a lithographic press and the like having a rotating plate cylinder and an inking form roller engageable with said plate cylinder, said apparatus comprising:

an applicator roller engagement with said plate cylinder;

a distribution roller engageable with said applicator roller and said form roller;

metering means for applying a metered amount of dampening fluid to said applicator roller while said distribution roller is simultaneously engaged with both said applicator roller and said form roller;

means for selectively moving said distribution roller to a position in which said distribution roller is disengaged from said form roller while said distribution roller remains engaged with said applicator roller;

and means for maintaining said distribution roller in said position disengaged from said form roller and in engagement with said applicator roller.

9. The dampening apparatus as claimed in claim 8, wherein said metering means includes:

a transfer roller engageable with said applicator roller;

a metering roller engageable with said transfer roller;

and fountain means for applying dampening fluid to said metering roller.

* * * * *